US006802699B2

(12) United States Patent
Mikami et al.

(10) Patent No.: US 6,802,699 B2
(45) Date of Patent: Oct. 12, 2004

(54) MOTOR MOUNTING STRUCTURE

(75) Inventors: Takashi Mikami, Tokyo (JP); Hiroyuki Kawada, Tokyo (JP)

(73) Assignee: Calsonic Kansei Corporation, Tokyo (JP)

( * ) Notice: Subject to any disclaimer, the term of this patent is extended or adjusted under 35 U.S.C. 154(b) by 0 days.

(21) Appl. No.: 10/455,330

(22) Filed: Jun. 6, 2003

(65) Prior Publication Data

US 2003/0228219 A1 Dec. 11, 2003

(30) Foreign Application Priority Data

Jun. 6, 2002 (JP) ..... 2002-165869

(51) Int. Cl.[7] ..... F04B 17/00

(52) U.S. Cl. ..... 417/369; 417/366; 417/423.14; 417/423.15; 415/204; 415/206; 415/213.1; 415/214.1; 310/62; 310/63

(58) Field of Search ..... 415/213.1, 214.1, 415/204, 206; 417/366, 369, 423.14, 423.15; 310/62, 63

(56) References Cited

U.S. PATENT DOCUMENTS 4,767,285 A * 8/1988 Jyoraku et al. ..... 417/366
5,156,524 A * 10/1992 Forni ..... 415/206
5,839,879 A * 11/1998 Kameoka et al. ..... 415/206
6,604,906 B2 * 8/2003 Ozeki et al. ..... 415/204

FOREIGN PATENT DOCUMENTS

JP 7-28707 U 5/1995
JP 8-127221 A 5/1996

* cited by examiner

*Primary Examiner*—Christopher Verdier
(74) *Attorney, Agent, or Firm*—Foley & Lardner LLP

(57) ABSTRACT

A ring-like rib 19 is erected on an inner circumferential edge of an insertion hole 11, which is opened in the scroll casing 1 so that the fan f is inserted therethrough, while a side wall 18 facing the ring-like rib 19 is provided in the bracket 15 blocking the insertion hole 11. A helical groove portion 20 and a protruding portion 21 are formed in one of an outer surface of the side wall 18 and an inner surface of the ring-like rib 19 and in the other thereof, respectively. The bracket 15 is caught in the scroll casing 1 by turning the bracket 15 in a direction opposite to a direction of rotation of said fan f. Further, during the engagement therebetween, a cooling duct 4 is formed.

14 Claims, 10 Drawing Sheets

MOTOR MOUNTING STRUCTURE

The present disclosure relates to the subject matter contained in Japanese Patent Application No. 2002-165869 filed on Jun. 6, 2002, and in Japanese Patent Application No. 2001-191218 filed on Jun. 25, 2001, which are incorporated herein by reference in their entirety.

BACKGROUND OF THE INVENTION

1. Field of the Invention

The present invention relates to an improvement of a blower built into a vehicular air conditioner, and more particularly, to an improvement of a structure for mounting a motor used in the blower.

2. Description of the Related Art

Generally, a vehicular air conditioner includes an intake portion having a blower for taking in air drawn from the inside and the outside of a passenger compartment, a cooler portion for cooling the taken air, and a heater portion for heating the cooled air.

As shown in FIG. 16, the intake portion has a blower accommodating a centrifugal blowing fan, which is driven by a motor M, in a scroll casing 1. Passenger compartment inside air or outside air is selectively taken into the scroll casing 1 from an inside-air/outside-air switching portion through an air intake port (referred to also as a bell-mouth) by driving the centrifugal blowing fan. Then, the taken air is let to flow into the succeeding cooler portion or heater portion from an outlet 3 of the scroll casing 1.

Incidentally, in the figure, reference numeral 4 designates a cooling duct that introduces part of an airflow, which flows in the scroll casing 1, into a motor housing 5 and that cools the motor M.

Further, the mounting of the motor M is performed as follows. That is, a bracket 6 is attached to the periphery of the motor housing 5 by welding or pressure-welding. On the other hand, the centrifugal blowing fan f is attached to a rotating shaft of the motor M and then inserted into the scroll casing 1 through an insertion hole opened in the scroll casing 1. Subsequently, the gap between the hole and the motor housing 5 is sealed by bracket 6, while the bracket 6 is fastened with screws 7, to the bracket 6 at three points.

However, in the case of inserting the motor M from the insertion hole with the inside-air/outside-air switching portion 2 down and then tightening up the screws, usually, the bottom surface of the inside-air/outside-air switching portion 2 is not parallel with the mounting surface of the bracket 6. Thus, it is difficult to tighten the screws in a stable state. Later, when the maintenance of the vehicular air conditioner is performed, it is necessary to spend time and effort to loosen and tighten the screws 7. It takes man-hours to perform the fabrication, assembly, and disassembly of the blowing fan. Such an air conditioner has a disadvantage in cost, and a drawback in weight.

An air conditioner improved in these respects has been proposed, in which helical rough pieces are provided on the peripheral surface of a flange formed on the peripheral surface of the motor housing 5 and the inner circumferential surface of the scroll casing and in which both the motor housing 5 and the scroll casing are connected to each other by turning the flange with respect to the scroll casing (see, for example, JP-A-8-127221).

However, the configuration results in direct coupling between the flange and the scroll casing. Thus, there are fears that not only degradation in the sealability of the gap between the insertion hole of the scroll casing and the motor but backlash easily occurs, and that air leakage and vibrational sounds occur. Further, in the case that the scroll casing is made to be sharable and to have only certain insertion holes, there is another fear that a motor having a different outer diameter cannot be mounted therein.

Furthermore, related art air conditioners have another drawback in formation of a cooling duct. For instance, as shown in FIG. 17, a vehicular blower disclosed in JP-UM-A-7-028707 is configured so that a bracket 6 and a motor accommodating portion 16 are integrally formed, that an end face of a scroll casing is constituted by the bracket 6, and that a part in the vicinity of a peripheral end of the bracket 6 and the motor accommodating portion 16 are linearly linked by a cooling duct 4.

In the blower, a cooling cold-air intake port 8 is formed outside an area covered by the outer diameter of a fan f. Further, the outer diameter of the bracket 6 is larger than an outer diameter usually required at exchange of the fan f. Therefore, when the motor M is exchanged, an exchange operation should be performed by simultaneously preventing the motor M from conflicting with other components of a vehicle. Consequently, the related art has a drawback in that the exchange operation cannot be smoothly performed.

Similarly, the cooling duct 4 is attached to the bracket 6 by another member. Therefore, the number of components increases. Additionally, an attaching operation should be performed by taking the prevention of an occurrence of air leakage from the bracket 6 into consideration. These become a factor that deteriorates workability.

SUMMARY OF THE INVENTION

The invention is accomplished to solve the drawbacks of the related art. Accordingly, an object of the invention is to provide a motor mounting structure that can eliminate the fears of occurrences of air leakage and vibrational sounds, that can facilitate the mounting and removal of a motor, that has advantages in cost and weight, that can be easily recycled and suitable for environmental protection, that can miniaturize a bracket having a cooling duct, and that enhances the mountability of the bracket.

In order to achieve the object, according to a first aspect of the invention, there is provided a motor mounting structure including: a scroll casing adopted to surround a fan; a bracket adopted to mount a motor, which drives the fan; an insertion hole formed on the scroll casing for inserting the fan therethrough; a ring-like rib erected on an inner circumferential edge of the insertion hole; a side wall disposed to the bracket in a manner to face the ring-like rib; a helical groove portion formed in one of an outer surface of the side wall and an inner surface of the ring-like rib; and a protruding portion engaging with the helical groove portion formed in the other of the outer surface of the side wall and the inner surface of the ring-like rib, wherein the bracket is attached onto the scroll casing by screwing the bracket into the scroll casing in a direction opposite to a direction of rotation of the fan, and in a state that the helical groove portion and the protruding portion are engaged with each other.

In order to achieve the object, according to a second aspect of the invention, there is provided a motor mounting structure including: a scroll casing adopted to surround a fan, having an insertion hole for inserting the fan thereinto formed in a wall portion at a side thereof; and a bracket adopted to mount a motor, which drives the fan, having a motor accommodating portion adopted to accommodate the motor, a cover portion adopted to close the insertion hole, and a cooling duct adopted to introduce a part of air flowing within the scroll casing into the motor for cooling the motor, wherein the bracket further including: a side wall perpendicular to a wall portion of the scroll casing, formed in a peripheral part of the cover portion, adopted to hermetically engage with an inner circumferential edge of the insertion hole when the cover portion is inserted into the scroll casing; and a opening portion formed in a peripheral part of the cover portion, adopted to be connected with the cooling duct so as to introduce a part of air flowing within the scroll casing into the motor through the cooling duct.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Referring now to the accompanying drawings, there is shown a preferred embodiment of the invention.

Figure 1:
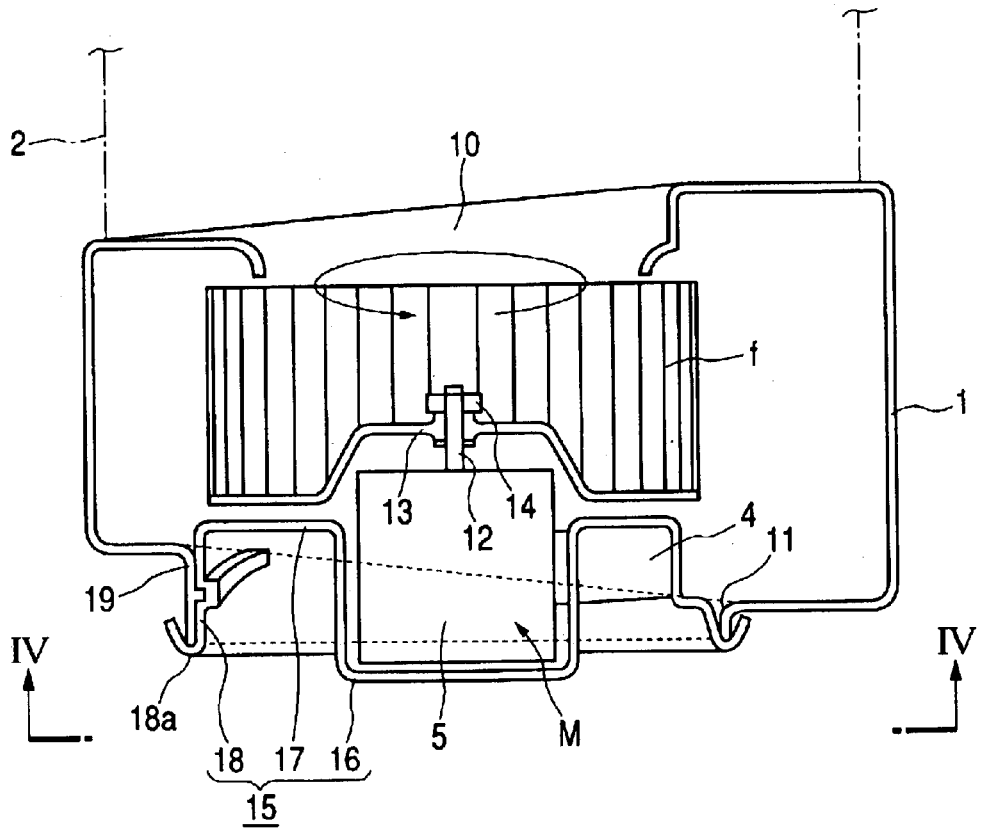
FIG. 1 is a schematic sectional view illustrating a motor mounting structure according to according to a first embodiment of the invention.
Figure 2:
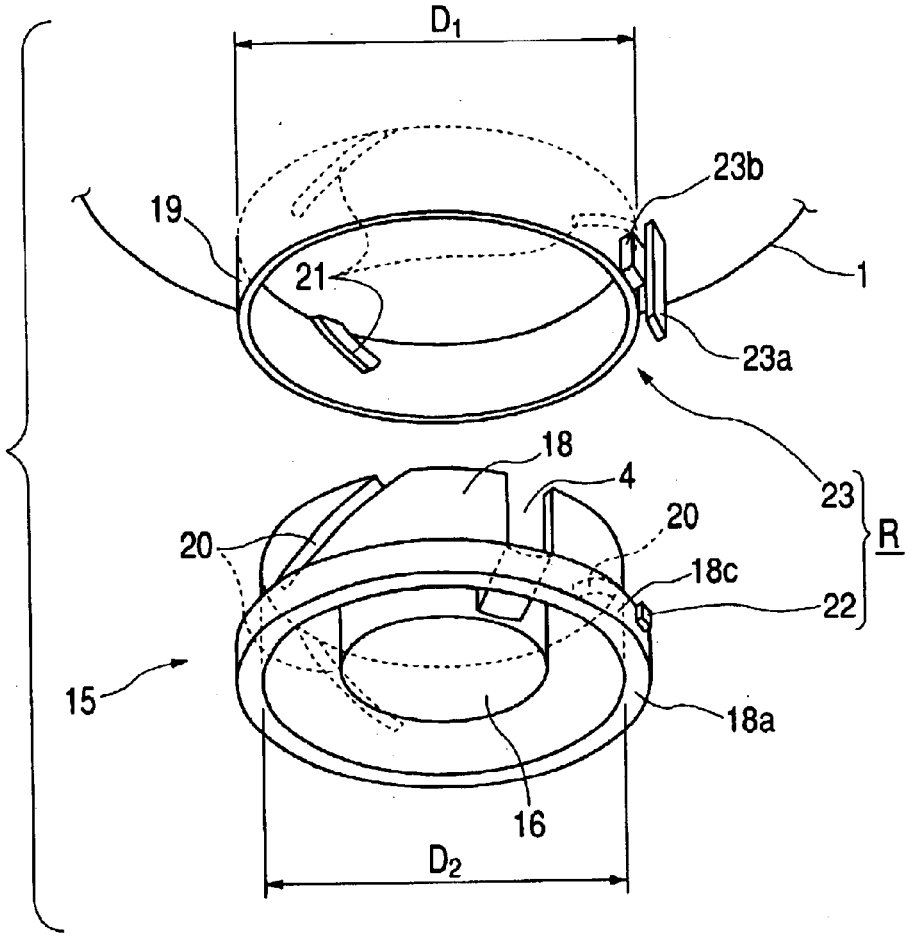
FIG. 2 is a perspective view illustrating a primary part of the structure shown in FIG. 1.
Figure 3A:
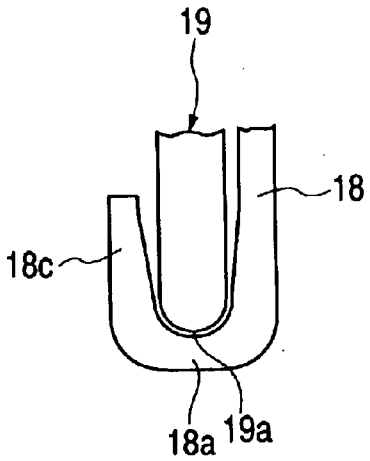
FIGS. 3A to 3C are sectional views each illustrating a state in which a bracket abuts against a ring-like rib.
Figure 3B:
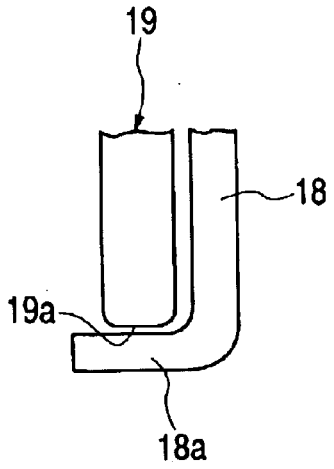
Figure 3C:
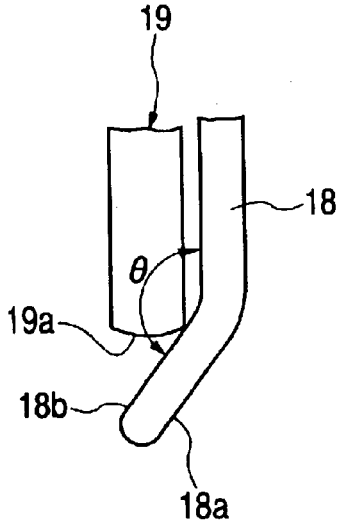
Figure 4:
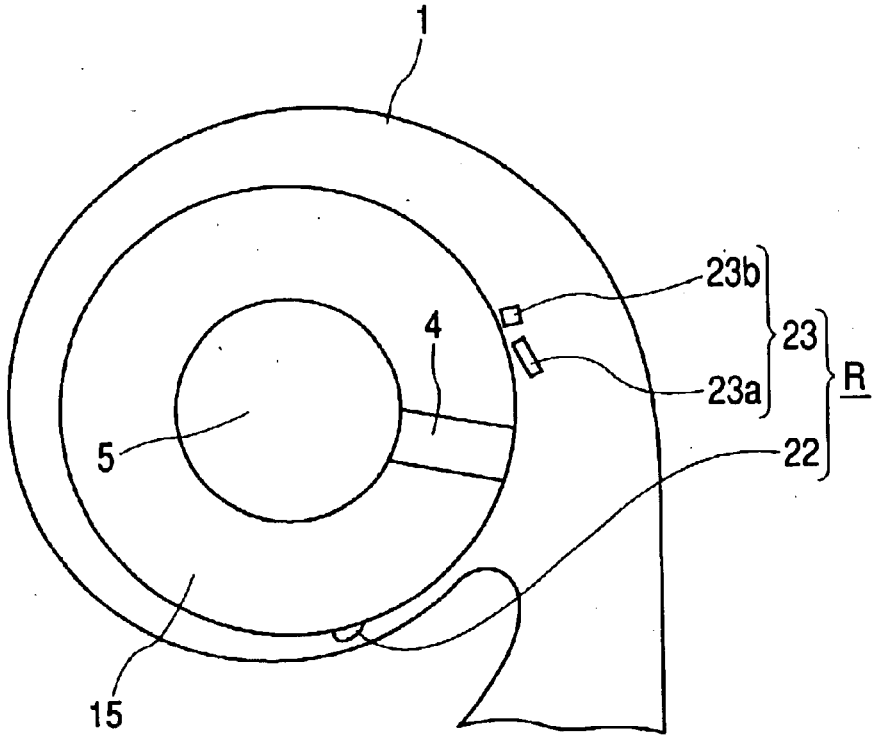
FIG. 4 is a view taken in the direction of an arrow along line IV—IV of FIG. 1.
Figure 5:
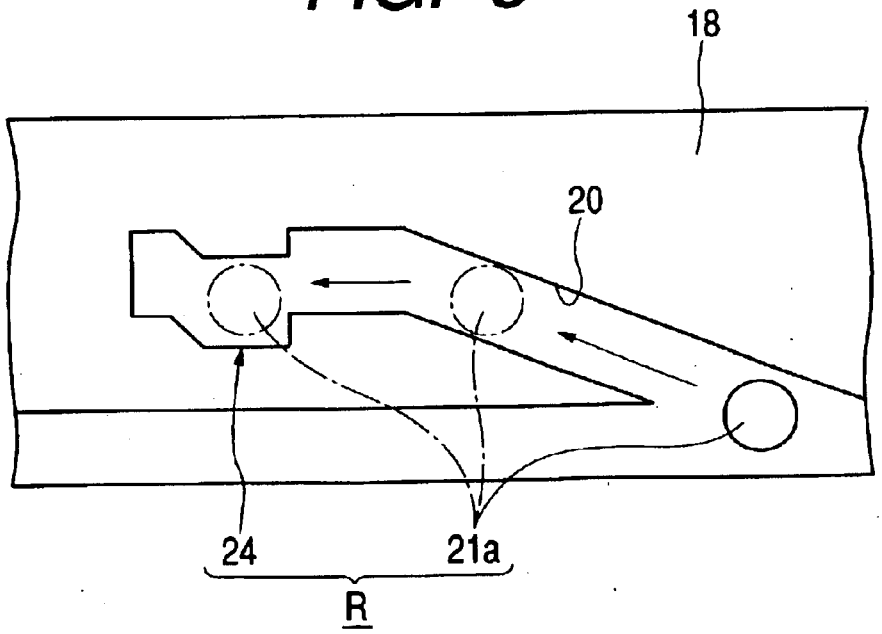
FIG. 5 is a primary-part side view illustrating a modification of each of a helical groove portion and a protruding portion according to the invention.
Figure 16:
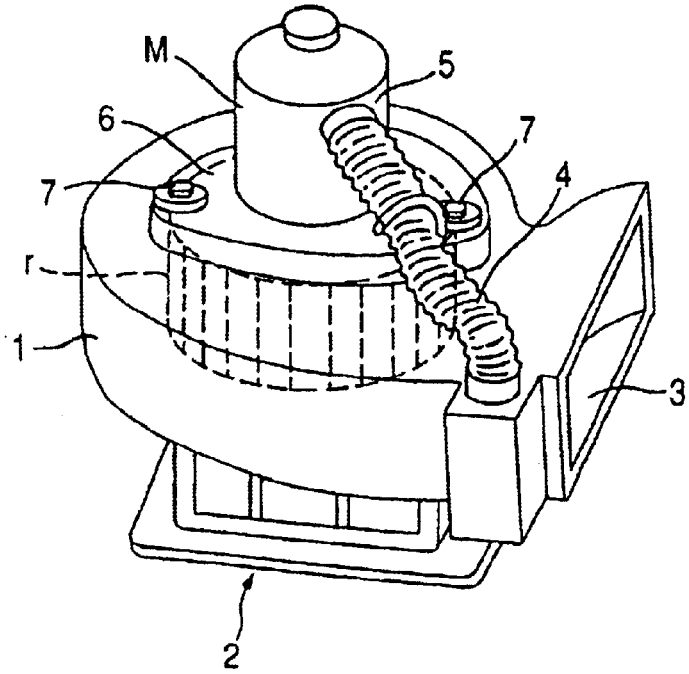
FIG. 16 (Prior Art)
FIG. 16 is a schematic perspective view illustrating a related art motor mounting structure.
Figure 17:
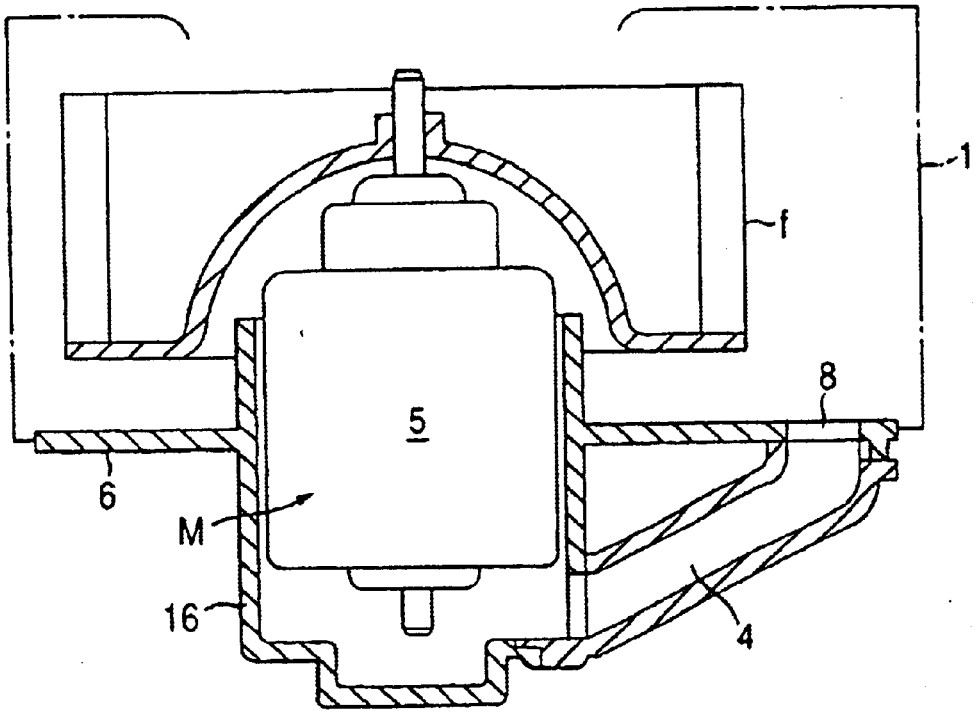
FIG. 17 (Prior Art)
FIG. 17 is a schematic sectional view illustrating the related art motor mounting structure.

FIG. 1 is a schematic sectional view illustrating a motor mounting structure according to a first embodiment of the invention. FIG. 2 is a perspective view illustrating a primary part of the structure shown in FIG. 1. FIGS. 3A to 3C are sectional views each illustrating a state in which a bracket abuts against a ring-like rib. FIG. 4 is a view taken in the direction of an arrow along IV—IV line of FIG. 1. FIG. 5 is a primary-part side view illustrating a modification of each of a helical groove portion and a protruding portion according to the invention. In these figures, members shown in common in FIGS. 16 and 17 are designated by the same reference characters used in FIGS. 16 and 17.

As illustrated in FIG. 1, a blower of a vehicular air conditioner according to the first embodiment has a scroll casing 1 in which an airflow passage spirally extending from the center thereof is formed. An air intake port 10 is provided above the center of the scroll casing 1. An insertion hole 11 is provided below the air intake port 10 in such a way as to be coaxial with the air intake port 10. The bore diameter of the air intake port 10 is smaller than the outer diameter of a centrifugal blowing fan f with the intention of reducing fan noise and enhancing air intake efficiency. On the other hand, the bore diameter of the insertion hole 11 is larger than the outer diameter f of the blowing fan f. This facilitates the insertion of the fan f and a motor M to be inserted therefrom.

The motor M has a rotating shaft 12 projecting from a motor housing 5 that accommodates a rotor and a magnet. The boss portion of the centrifugal blowing fan f is attached to the rotating shaft 12 by a nut 14.

The motor housing 5 is attached to a bracket 15. At the center of the motor housing 5, a motor accommodating portion 16 is formed. The motor accommodating portion is a concave portion into which the motor housing 5 is closely fitted. A cover portion 17 serving as an intermediate plate radially extends from the motor accommodating portion 16. A side wall 18 is formed on the peripheral edge of the cover portion 17 in such a way as to extend outwardly (that is, downwardly, as viewed in FIG. 1) from the scroll casing 1.

On the other hand, a ring-like rib 19 is erected on the inner circumferential edge of the insertion hole 11 of the scroll casing 1 in such a way as to protrude outwardly (that is, downwardly, as viewed in FIG. 1) from the scroll casing 1. This ring-like rib 19 faces the side wall 18 so that the bore diameter $D_1$ thereof (see FIG. 2) is slightly larger than the outer diameter $D_2$ (see FIG. 2) of the side wall 19 and that the bracket 15 is smoothly inserted into the insertion hole 11 and screwed.

The operation of inserting and screwing the bracket 15 is performed by turning the bracket 15. Helical groove portions 20, which are formed at three places on the outer surface of the side wall of the bracket 15, and protruding portions 21 formed at three places on the inner surface of the ring-like rib 19 are respectively screwed. Thus, the bracket 15 is caught in the scroll casing 1.

In the case that the helical groove portions 20 are formed on the outer surface of the side wall of the bracket 15, and that the protruding portions 21 are provided on the inner surface of the ring-like rib 19, the scroll casing 1 and the motor M can be easily be connected to each other by screwing the protruding portions into the groove portions, respectively. Moreover, in such a case, the insertion hole 11 of the scroll casing 1 can be closed by the bracket 15. Additionally, even when the insertion hole 11 of the scroll casing 1 differs in outer diameter from the motor M, there can easily be dealt with by adjusting only the component that is the bracket 15. This has an advantage in cost.

That is, although the bracket 15 blocks up the gap between the scroll casing 1 and the motor M, various kinds of processing or molding of the bracket 15 can be performed independently-when configured as an independent component. The size of the bracket 15 itself and the positions and shapes of the helical groove portion 20 and the protruding portion 21 can easily and suitably be changed according to the counterpart ring-like rib 19.

Incidentally, although the shape of a section of the helical groove portion 20 is a rectangle, the shape thereof is not limited thereto. Various shapes, such as a triangle, a semicircle, and an ellipse, may be employed as that of a section of the helical groove portion 20. Needless to say, a section of the protruding portion 21 has a shape corresponding to that of a section of the helical groove portion 20.

Preferably, the screwing in the case of connecting the motor M to the scroll casing 1 is performed so that the engagement between the motor M and the scroll casing 1 is achieved by turning the bracket 15 in a direction opposite to the direction of rotation of the centrifugal blowing fan f (that is, the direction of an arrow of FIG. 1). Rotation of the centrifugal blowing fan f allows the helical groove portion 20 and the protruding force 21 to enhance fastenability. Even when vibrations are applied thereto, the connection therebetween is not loosened. The connecting state of the portions 20 and 21 can be further surely held.

After the motor M is inserted into and connected to the scroll casing 1, a terminal end portion 18*a* of the side wall of the bracket 15 is brought into intimate contact with a leading end portion 19*a* of the ring-like rib 19. Thereby, an occurrence of air leakage from the scroll casing 1 is prevented.

The establishment of the closely contacted state thereof causes the side wall 18 of the bracket 15 and the ring-like rib 19 to have shapes shown in, for example, FIGS. 3A to 3C. That is, as shown in FIG. 3A, the terminal end portion 18*a* of the side wall 18 is bent in such a way as to have a U-shaped section. Moreover, the leading end portion 19*a* of the ring-like rib 19 is cut off in such a way as to be shaped like an arc. Thus, both the terminal end portion 18*a* and the leading end portion 19*a* are strongly fitted to each other by inserting the convex portion 19 into the concave portion 18*a*. Moreover, the contact area therebetween increases. Consequently, an occurrence of air leakage can be more effectively prevented.

The terminal end portion 18*a* of the side wall 18 may be bent in such a way as to have a hook-like section, and the leading end portion 19*a* of the ring-like rib 19 may be cut off flat, as shown in FIG. 3B. Alternately, as shown in FIG. 3C, the bending angle θ of the terminal end portion 18 of the side wall maybe set to be an obtuse angle. Further, the arcuate leading end portion 19 may be made to abut against the tapered surface 18*b* formed thereon.

Thus, the side wall 18 of the bracket 15 surely abuts against the ring-like rib 19, so that the sealability is enhanced. Further, when the bending angle θ of the terminal end portion 18 is set to be an obtuse angle, similarly as the latter cases an unnecessary force generated in the case of too tightly fastening the bracket 6 can be relieved.

In the either structure, the screwing of the helical groove portion 20 and the protruding portion 21 causes the bracket 15 to come close to the ring-like rib 19, so that the adhesiveness between the terminal end portion 18*a* of the side wall 18 and the leading end portion 19*a* of the ring-like rib 19 is enhanced. Consequently, an occurrence of air leakage can be more surely prevented.

The closely contacted state thereof becomes effective only by the screwing of the helical groove portion 20 and the protruding portion 21, which come to have better fastenability. However, the closely contacted state may be reliably held by providing parts of the lock member R in the bracket 15 and the ring-like rib 19, respectively, and engaging these parts with each other.

The closely contacted state is effectively held and an occurrence of air leakage can be prevented by configuring the lock member R as described hereinbelow. For example, as illustrated in FIGS. 2 and 4, a projection 22 is provided on the peripheral wall 18*c* formed by bending the terminal end portion 18*a* of the bracket in such a way as to have a U-shaped section. Further, an engaged piece 23 is provided on the ring-like rib 19. When a turn of the bracket 15 approaches an end, that is, when the terminal end portion 18*a* of the side wall 18 and the leading end portion 19*a* of the ring-like rib 19 are brought into the closed contacted state, the projection 22 and the engaged piece 23 are engaged with each other and locked.

In particular, the lock member R of the embodiment includes the projection 22 projecting outwardly from the peripheral wall 18*c*, and the engaged piece 23 including an elastic projecting piece 23*a* adapted to be deformed when the projection 22 goes thereover, and a stopper 23*b*, with which the projection 22 collides, for stopping the projection 22. Thus, when the projection 22 turns from the position shown in FIG. 4 and goes over the elastic projecting piece 23*a* and hits the stopper 23*b*, the projection 22 is held by the elastic projecting piece 23*a* in such a manner as to be unable to retreat.

Preferably, the bracket 15 and the scroll casing 1 are formed from a deformable synthetic resin, because of the facts that the formation of the lock member R is facilitated, that the weight of the entire structure decreases, and that the mass production of the structure is enabled. Incidentally, although it is preferable that both the bracket 15 and the scroll casing 1 are made of a deformable synthetic resin, it is sufficient that only one of the bracket 15 and the scroll casing 1 is made of a deformable synthetic resin.

The configuration of the embodiment is not limited to that employing the lock member R. For instance, the structure may be configured as illustrated in FIG. 5. The structure shown in FIG. 5 utilizes the engagement between the helical groove portion 20 and the protruding portion 21. The protruding portion 21 is formed in such a way as to be a pin-like protruding portion 21*a*. A step-like portion 24 is formed in such a way as to be enabling to retreat when the pin-like protruding portion 21*a* is fitted into the terminal end portion of the helical groove portion 20.

Thus, there is no need for forming the projection 22 and the engaged piece 23. Similar functions can be achieved only by changing the groove shape of the helical groove portion 20. Thus, the configuration of the structure is extremely simplified.

Figure 6:
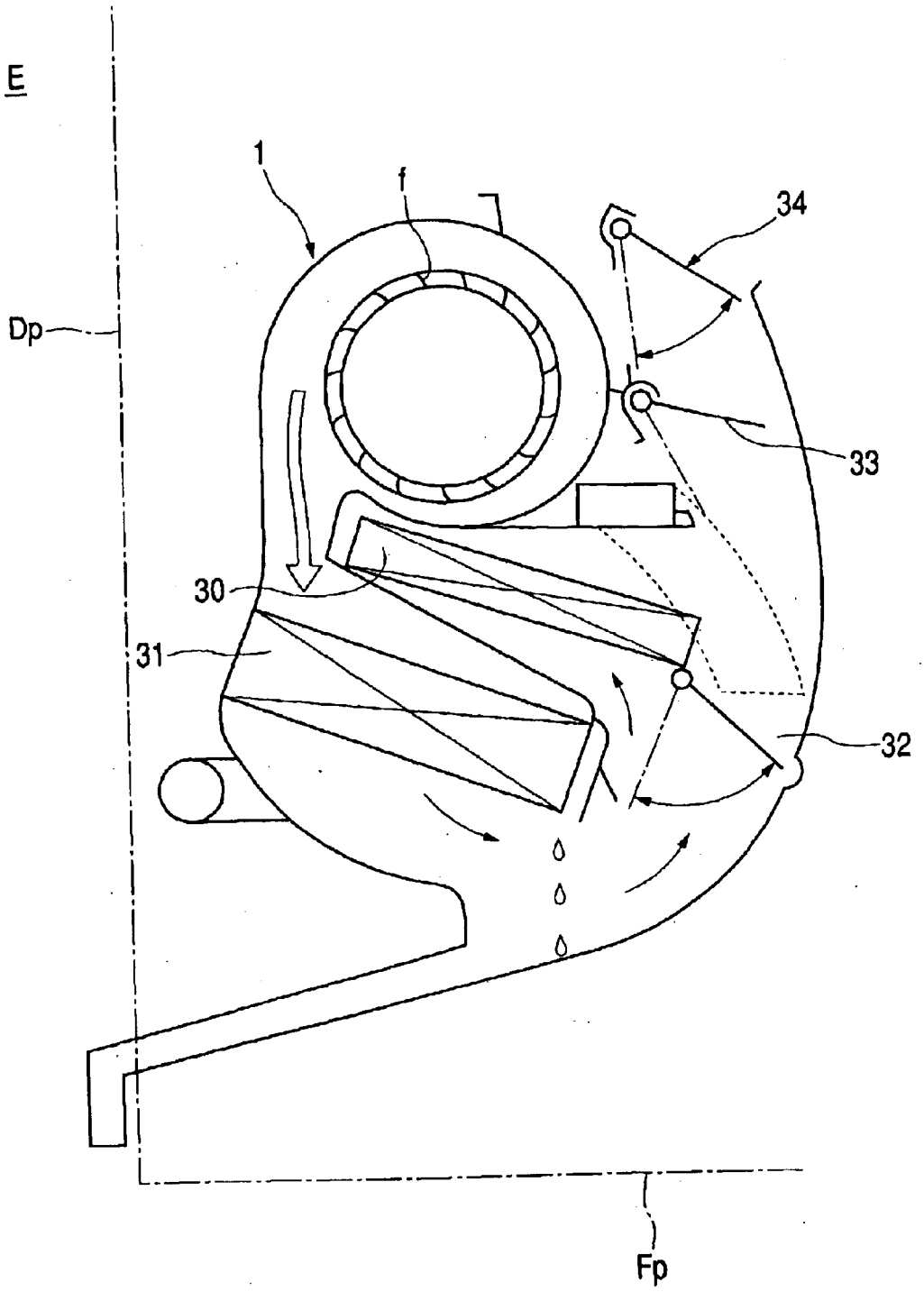
FIG. 6 is a schematic sectional view illustrating an integral vehicular air conditioner, to which the invention is applied.

Although the case of mounting the motor M therein from below has been described in the foregoing description of the first embodiment, the invention is not limited thereto. In the case of the integral vehicle air conditioner shown in FIG. 6, the motor M can be mounted therein from side. Incidentally, FIG. 6 is a sectional view illustrating the application of the first embodiment to an integral vehicle air conditioner.

In the case of the integral vehicle air conditioner, the entire unit case is formed by mating two pieces to each other. Therefore, in the case of employing the aforementioned motor mounting structure, only the motor can be mounted after the assembly of the entire unit. Thus, the workability can be extremely enhanced.

Incidentally, reference numeral 30 designates a heater core, reference numeral 31 denotes an evaporator, reference numeral 32 indicates a mixing door, reference numeral 33 represents a foot door, reference numeral 34 designates a defrosting door, reference character Dp denotes a dash panel, reference character E indicates an engine room, reference character S represents a passenger compartment, and reference character Fp designates a floor panel.

Next, the embodiment improving a bracket, which has the cooling duct, is described hereinbelow.

The bracket 15 of the second embodiment has the cooling duct 4 linking an opening portion $O_1$ of the side wall 18 and an opening portion $O_2$ opened in the motor accommodating portion 16 by utilizing a dead space between the side wall 18 and the motor accommodating portion 16. However, the necessity for additional components, such as a cooling pipe, can be eliminated by forming the cooling duct 4 in such a way as to be integral with the bracket 15. Consequently, the cost of the structure can be reduced.

Especially, in the embodiment, the bracket 15 is incorporated into the scroll casing 1 by providing the opening portion $O_1$ in the side wall 18 of the bracket 15. Thus, the bracket 15 is directly or indirectly linked by the cooling duct 4 with the scroll casing 1.

Consequently, there is no necessity for extending the bracket 15 to the neighborhood of a peripheral region of the scroll casing 1. Thus, the bracket 15 itself can be prevented from being upsized. The need for additional components and for countermeasures against air leakage, which would be necessary in the case of providing a dedicated cooling duct, is eliminated. The fabrication, assembly and disassembly of the motor are facilitated. Consequently, the structure has an advantage in cost. In this regard, a detailed description is given hereinbelow.

Figure 7:
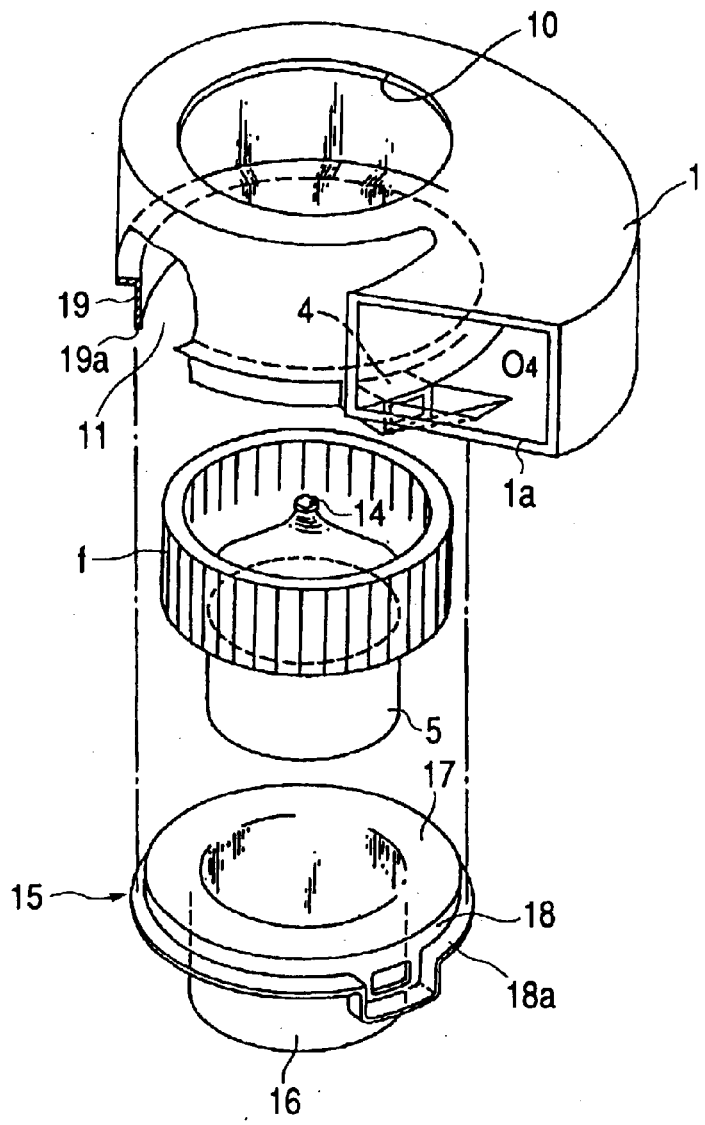
FIG. 7 is an exploded perspective view illustrating a second embodiment of the invention.
Figure 8:
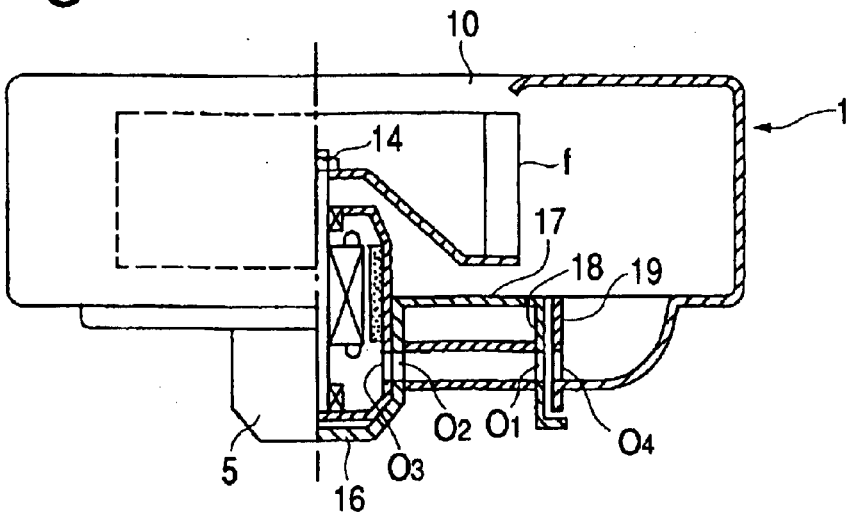
FIG. 8 is a sectional view illustrating the second embodiment in an assembly state.

FIG. 7 is an exploded perspective view illustrating a second embodiment of the invention. FIG. 8 is a sectional view illustrating the second embodiment in an assembled state.

The bracket 15 of the second embodiment is provided with the cooling duct 4 linking the scroll casing 1 with the motor housing 5. The bracket 15 is configured so that the cover portion 17 has an outer diameter larger than the outer diameter of the fan f, thereby facilitates the insertion and take-off of the motor provided with the fan f.

The side wall 18 provided on the peripheral part of the cover portion 17 is formed in such a way as to be perpendicular to a wall portion (that is, the bottom wall) of the scroll casing 1. Consequently, the bracket 15 can be easily and smoothly inserted into the insertion hole 11 of the scroll casing 1.

Further, the opening portion $O_1$ is opened in the side wall 18. The opening portion $O_1$ is surrounded by the terminal end portion 18*a* of the side wall 18. When the bracket 15 and the scroll casing 1 are united, the ring-like rib 19 abuts against the terminal end portion 18*a*, so that air flowing from the scroll casing 1 is prevented from leaking from the opening portion $O_1$ and that an air sealing state is held.

On the other hand, a swelling portion 1*a* adapted to downwardly swell is provided on one wall portion (that is, the bottom wall) of the scroll casing 1. An opening portion $O_4$ is provided in the ring-like rib 19 formed in the end part of the swelling portion 1*a*. A part of an airflow flowing in the scroll casing 1 is introduced to the motor housing 5 through the opening portion $O_4$ and the opening portion $O_1$.

In the case that the opening portion $O_4$ is provided in such a way as to face the opening portion $O_1$, the ring-like rib 19 and the side wall 18 are airtightly engaged with each other only by uniting the bracket 15 and the scroll casing 1. Thus, airflow in the scroll casing 1 can be introduced to the motor without leaking to the outside. That is, air introduced from the opening portion $O_4$ flows from the opening portion $O_1$ formed in the ring-like rib 19, through the opening portion $O_2$ of the motor accommodating portion 16, to the opening portion $O_3$ of the motor M. Thus, the cooling duct 4 linking the sequence of the opening portions $O_4$, $O_1$, $O_2$ and $O_3$.

Moreover, the bracket 15 can be linked with an airflow passage provided in the scroll casing 1 without unnecessarily upsizing the bracket 15. Moreover, the necessity for additional components and countermeasures against air leakage, which are needed when a dedicated cooling duct is provided, can be eliminated. The assemblability thereof can be improved.

Figure 9:
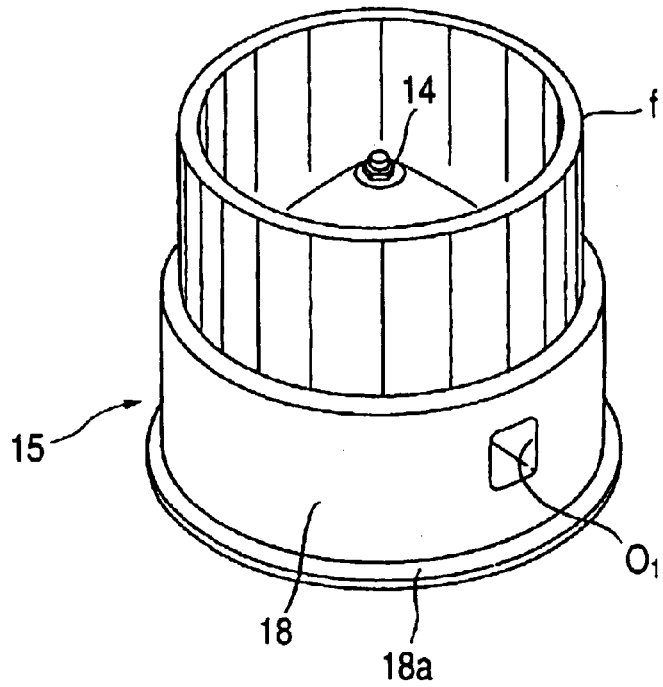
FIG. 9 is a primary-part perspective view illustrating a third embodiment of the invention.
Figure 10:
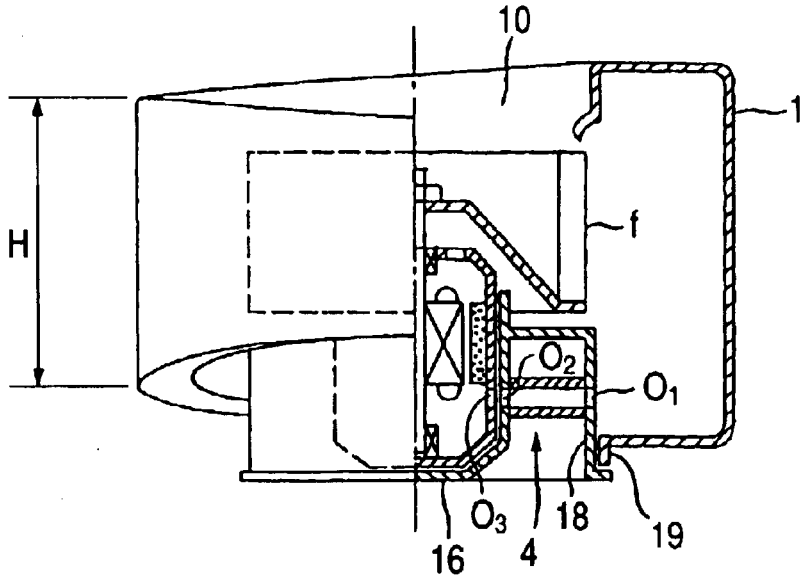
FIG. 10 is a semi-sectional view illustrating the third embodiment.

FIG. 9 is a primary-part perspective view illustrating a third embodiment of the invention. FIG. 10 is a semi-sectional view illustrating the third embodiment.

The third embodiment is adapted so that the side wall 18 of the bracket 15 is formed like a cylinder. The remaining constituent elements of the third embodiment are similar to the corresponding constituent elements of the second embodiments illustrated in FIGS. 7 and 8.

The third embodiment employing such a cylindrical side wall 18 is an extremely advantageous means having advantages in that when the bracket 15 is attached to the scroll casing 1, whose axial dimension increases according to a winding angle (to be described later) of the scroll casing 1, by screwing, the opening portion $O_1$ opened in the side wall 18 can be linked with the airflow passage in the scroll casing 1 independent of the opening position of the opening portion $O_1$, and that a part of the wall of the airflow passage of the scroll casing 1 can be made by the side wall 18 of the bracket 15 to be sharable, in addition to the advantage that the aforementioned helical groove portion 20 can easily be formed.

Incidentally, in the case of fitting the cover portion 17 in the scroll casing 1, the position, at which the opening portion $O_1$ of the side wall 18 is provided, should be suitably selected so as to allow the opening portion $O_1$ of the cooling duct 4 provided in the side wall 18 to directly faces the inside of the scroll casing 1, and as to introduce the airflow flowing in the scroll casing 1 into the motor M.

Figure 11:
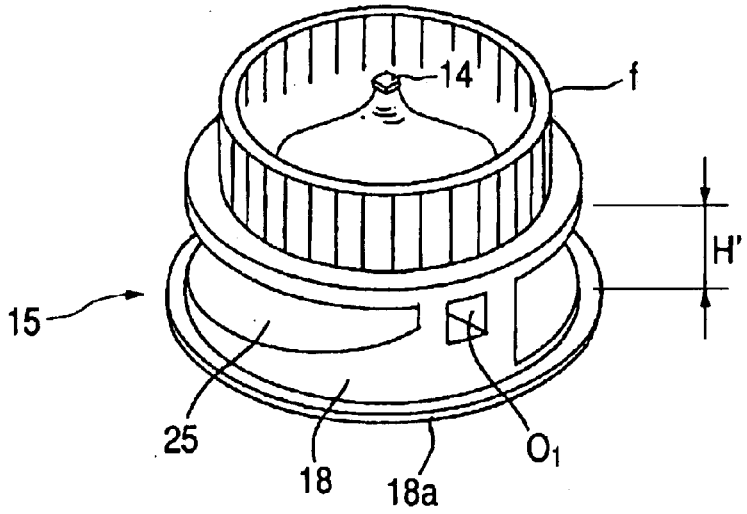
FIG. 11 is a primary-part perspective view illustrating a fourth embodiment of the invention.
Figure 12:
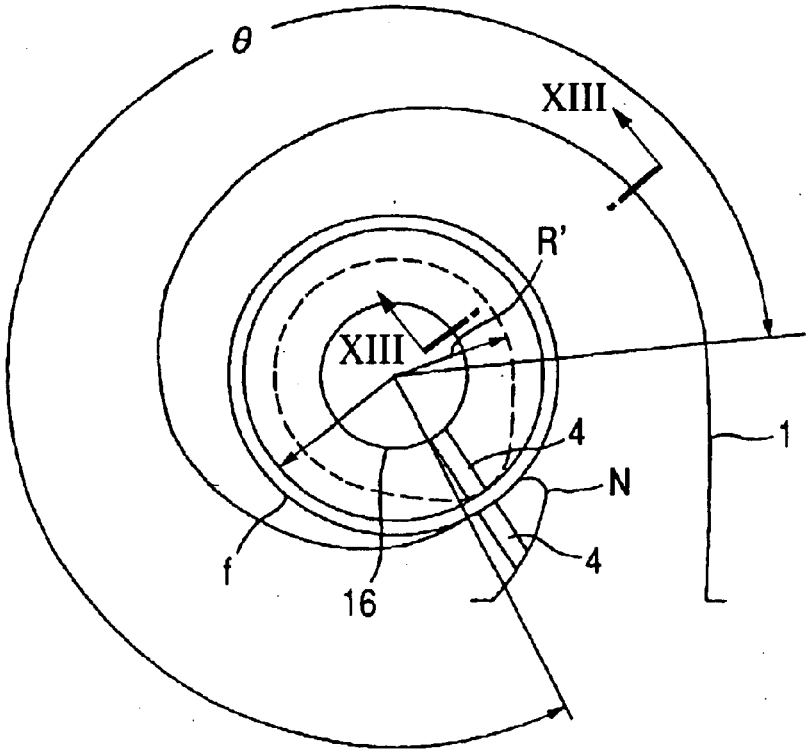
FIG. 12 is a schematic plan view illustrating the fourth embodiment.
Figure 13:
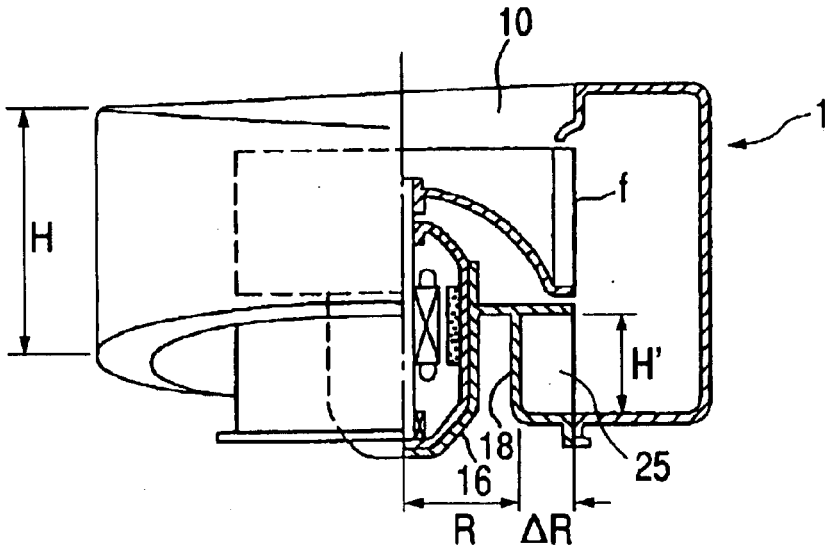
FIG. 13 is a semi-sectional view illustrating the fourth embodiment.

FIG. 11 is a primary-part perspective view illustrating a fourth embodiment of the invention. FIG. 12 is a schematic plan view illustrating the fourth embodiment. FIG. 13 is a semi-sectional view taken along XIII—XIII line of FIG. 12.

The fourth embodiment is configured so that a peripheral groove portion 25 is formed on the peripheral portion of the cylindrical side wall 18 in such a way as to face the airflow passage of the scroll casing 1 and as to be utilized as a sub-airflow-passage.

In the case of forming the cylindrical side wall 18 on the peripheral portion of the bracket 15, the flexibility in selecting the axial length H of the scroll casing 1 increases. Thus, there becomes convenient.

However, as described above, a dead space is generated between the side wall 18 and the motor accommodating portion 16. Thus, in the case of the fourth embodiment, as shown in FIGS. 11 and 12, the peripheral groove portion 25 is formed by-radially deforming a part of the side wall 18, so that the sectional area of the airflow passage increases, that the ventilation resistance thereof is reduced, and that a larger amount of air can be supplied.

Further, when a blowing air quantity has a predetermined value, the miniaturization of the scroll casing 1 is enabled by providing the sub-airflow-passage therein. In the case of employing a vehicle air conditioner provided on a lower portion of an instrument panel in a frontward part of the passenger compartment, a footwell can be increased to some extent in a narrow passenger compartment.

This peripheral groove portion 25 is adapted so that the outside radius R' gradually decreases (that is, changes from a larger value to a smaller value) according to the winding angle θ, and that the axial dimension H' gradually increases (that is, changes from a smaller value to a larger value) according to the winding angle θ. Incidentally, character "R" used in FIG. 12 designates the radius of the fan f, and character "H" denotes the axial dimension of the scroll casing 1.

The winding angle θ is an angle measured in a direction of rotation of the centrifugal blowing fan from a central point of the nose portion that defines the narrowest portion of the scroll casing.

The peripheral groove portion 25 is not necessarily limited to the aforementioned one. Another peripheral groove portion 25 adapted to change one or both of the outside radius R' and the axial dimension H' may be employed.

Generally, the scroll casing 1 is adapted so that the sectional area gradually changes. This is intended so that an airflow to be pressure-sent can be sent to a more distant place in a higher-pressure state. However, in the case that the peripheral groove portion 25 is formed in the aforementioned manner, and that a gradual increment of the sectional area is increased, a cross-sectional integral ΔR×H' is ensured, as illustrated in FIG. 13. Thus, the advantages of the scroll casing are not impaired. The entire scroll casing can be miniaturized.

Figure 14:
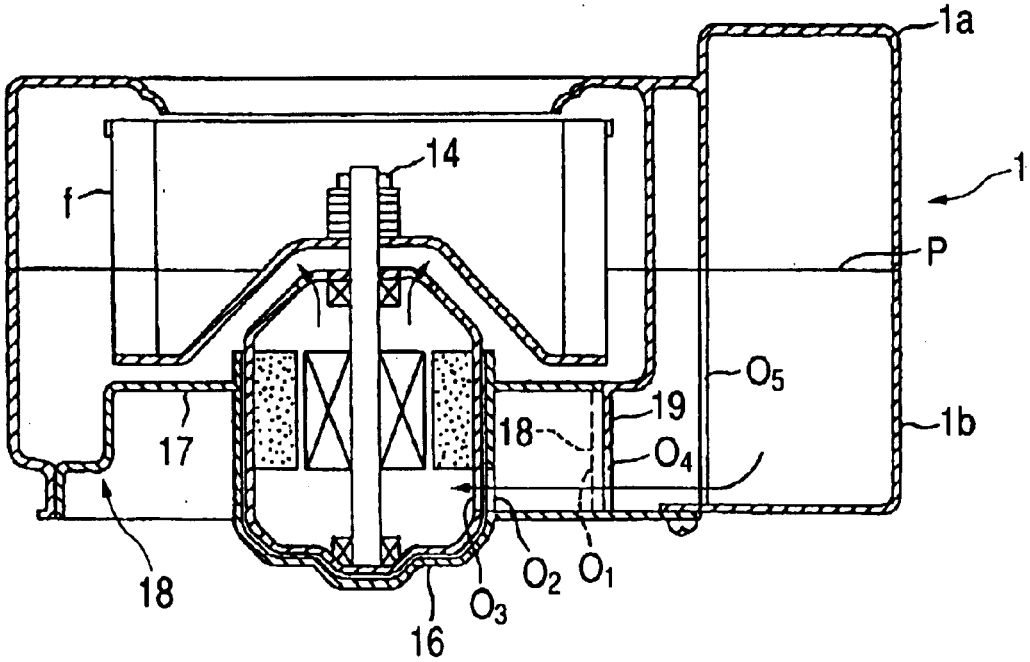
FIG. 14 is sectional view illustrating a fifth embodiment, which is taken along line XIV—XIV of FIG. 15.
Figure 15:
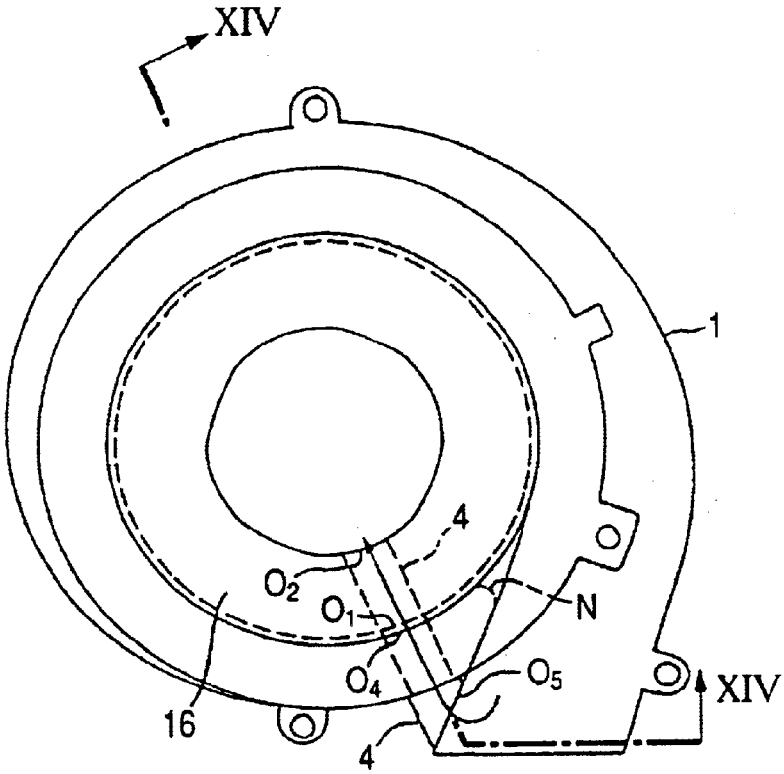
FIG. 15 is a bottom view illustrating the fifth embodiment.

FIG. 14 shows a fifth embodiment of the invention, and is a sectional view taken along XIV—XIV line of FIG. 15. FIG. 15 is a bottom view of the fifth embodiment.

The scroll casing 1 of the fifth embodiment is configured so that paired pieces two-divided by a parting-line P into upper and lower pieces are mated to each other, that a bellmouth is opened in the upper piece 1*a*, that a part of each of the insertion hole 11 and the cooling duct 4 is formed in the lower piece 1*b*, and that the bracket 15 is mounted in the insertion hole 11.

This bracket 15 has the side wall 18 on the periphery of the cover portion 17. This side wall 18 swells partly to the motor and partly to the inside thereof, so that a sub-airflow-passage similar to the aforementioned one is formed therein. Further, an opening portion $O_5$ is opened in a side wall element in the vicinity of a nose portion N of the lower piece 1*b*. This opening portion $O_5$ forms an air intake port of the cooling duct 4. That is, air introduced from the opening portion $O_5$ flows from the opening portion $O_4$formed in the ring-like rib 19 of the lower piece 1*b*, through the opening portion $O_1$ formed in the side wall 18 of the bracket 15, and through the opening portion $O_2$ of the motor accommodating portion 16, to the opening portion $O_3$ of the motor M. Thus, the cooling duct 4 linking the sequence of the opening portions $O_5$, $O_4$, $O_1$, $O_2$ and $O_3$.

Although the opening portion $O_5$ may be provided at a given place, it is preferable that the opening portion $O_5$ is provided at a winding-end portion of the scroll casing, for example, a part in the vicinity of the nose portion N. This is because of the facts that the pressure due to the airflow is high at the winding-end portion, and that a sufficient amount of airflow can easily be taken into the motor.

Next, an operation of the embodiment is described hereinbelow.

First, the motor housing 5 is press-fitted into the motor accommodating portion 16 that is a central concave portion of the bracket 15. Moreover, the centrifugal blowing fan f is attached to the rotating shaft 12 of the motor M. Thus, the motor M, the bracket 15, and the centrifugal blowing fan f are united to constitute a single component. The centrifugal blowing fan f of the component is inserted from the insertion hole 11 opened in the scroll casing 1.

Incidentally, at the insertion, the centrifugal blowing fan f is inserted thereinto in a state in which the bracket 15 is initially set to a position so that the leading end part of each of the helical groove portions 20 and the associated protruding portion 21 correspond to each other.

This insertion causes the cover portion 17 of the bracket 15 to seal the insertion hole 11. The side wall 18 is guided along the inner circumferential surface of the ring-like rib 19. When the side wall 18 enters the ring-like rib 19 by a certain distance, the leading end portion of each of the helical groove portions 20 is fitted to the associated protruding portion 21. Incidentally, when the leading end portion of each of the helical groove portions 20 is not fitted to the associated protruding portion 21, the bracket 15 is slightly turned, so that a fitted state, in which the leading end portion of each of the helical groove portions 20 is fitted to the associated protruding portion 21, can easily be obtained, because three pairs of the helical groove portion 20 and the projecting portion 21 are provided.

Then, the bracket 15 is turned, so that each of the protruding portions 21 moves by being guided along the associated helical groove portion 20. Thus, the bracket 15 not only turns around an axis but moves in an axial direction, that is, performs what is called a screwing turn. Thus, the terminal end portion 18*a* of the side wall 18 approaches the leading end portion 19*a* of the ring-like rib 19.

Subsequently, the bracket 15 is turned still more. Then, the projection 22 of the bracket 15 goes over the elastic projecting piece 23*a* and hits the stopper 23*b*. The protruding portion 21 reaches the terminal end of the associated helical groove portion 20. Consequently, the terminal end portion 18*a* of the side wall 18 and the leading end portion 19*a* of the ring-like rib 19 are brought into a closely contacted state. The closely contacted state is held by the projection 22 and the engaged piece 23.

In the case of the embodiment shown in FIG. 5, the pin-like protruding portion 21*a* is fitted into the step-like portion 24 provided in the terminal end portion of the helical groove portion 20, so that the step-like portion 24 becomes unable to retreat. Thus, similarly, the closely contacted state is realized. Consequently, the motor portion and the scroll casing 1 are connected to each other.

Further, during maintenance, in the case of the embodiment shown in FIG. 4, the bracket 15 is reversely turned in a state in which the elastic projecting piece 22*a* is deviated by manually or using a jig. Thus, the engagement therebetween is canceled. Consequently, the motor M, the bracket 15, and the centrifugal blowing fan f can be taken out as a single component.

In the case of the first embodiment shown in FIG. 5, the engagement between the pin-like protruding portion 21*a* and the step-like portion 24 is canceled by giving an appropriate reverse turning force thereto. Thus, similarly as the aforementioned case, the fan f, the motor M, and the bracket 15 can easily be taken out of the scroll casing 1.

In the first embodiment, the motor M can be fixed by simply screwing the bracket 15 into the scroll casing 1. When the locked state of the lock member R is canceled and the motor bracket 15 is reversely turned, the removal of the component can be performed. Thus, man-hours needed for assembly of the structure is reduced. The maintenance of the vehicle air conditioner is facilitated. Moreover, the bracket 15 itself is miniaturized, so that the screwing operation is easy to perform. Consequently, the workability is enhanced.

On the other hand, when the motor M is driven after connected in the manner, the fan f rotates, so that an airflow due to the rotation flows in the scroll casing 1. However, the terminal end portion 18*a* of the side wall 18 is in intimate contact with the leading end portion 19*a* of the ring-like rib 19. Thus, air does not leak therefrom to the outside.

Further, in the case of the second embodiment shown in FIGS. 7 and 8, an airflow flowing along one wall portion (that is, the bottom wall) in the scroll casing 1 is introduced from the opening portion O1 of the side wall 18 through the cooling duct 4 into the motor M. Thus, the airflow cools the inside of the case for the motor M as motor cooling air, and then runs out therefrom.

In the case of the third embodiment shown in FIGS. 9 and 10, the opening portion O1 opened in the side wall 18 of the cover portion 17 is made to directly face the scroll casing 1. Thus, an airflow flowing in the scroll casing 1 directly flows into the cooling duct 4 from the opening portion $O_1$ and cools the motor.

In the case of the fourth embodiment shown in FIGS. 11, 12 and 13, the sectional area of the airflow passage is increased by the peripheral groove portion 25 of the side wall 18. Thus, the ventilation resistance of the airflow passage decreases. A large amount of airflow flows into the cooling duct 4 from the opening portion $O_1$ and then cools the motor.

In the case of the fifth embodiment shown in FIGS. 14 and 15, the opening portion O5 is provided in the proximity of the nose portion N. Thus, a high-pressure airflow is introduced to the opening portion $O_5$. A sufficient amount of airflow easily flows into the motor. This airflow flows in one direction from the opening portion $O_5$, through the opening portion $O_4$, the opening portion $O_1$, the opening portion $O_2$ of the motor accommodating portion 16, the insertion hole of the motor housing, the inside of the motor, the insertion hole of the motor housing, to the scroll casing 1 in the order. Consequently, the inside of the motor can smoothly be cooled.

Incidentally, the invention is not limited to the aforementioned embodiments. Various modifications may be made without departing from the gist of the invention. For example, although the case, in which the motor M is mounted from below, has been described in the foregoing description of the embodiments, the invention is not limited to such a case. In the case of an integral vehicle air-conditioner, a motor M may be mounted from side.

As described above, according to the above-described embodiment, the helical groove portion and the protruding portion are formed in the-ring-like rib of the-scroll casing and the bracket at the side of the motor, respectively. And, the scroll casing and the motor are connected to each: other through the bracket. Thereby, the assembly and disassembly of the motor can be performed through one-touch operation. Further, removal of the motor can easily be achieved by performing a simple operation. Furthermore, the embodiment has advantages in weight and cost and enables the sharing of components.

According to the above-described embodiment, the terminal end of the side wall is brought into intimate contact with the leading end of the ring-like rib at the connection therebetween. Thus, there are no fears of occurrences of air leakage and vibrational sounds. Consequently, a blower with excellent performance is realized.

According to the above-described embodiment, the engagement state between the bracket and the scroll casing is held by the lock means. Thus, the connection between the scroll casing and the motor and the maintenance thereof are reliably achieved.

According to the above-described embodiment, the helical groove portion is formed in such a way as to have a step-like portion adapted to become incapable of retreating when the pin-like protruding portion is fitted thereinto. Thus, the connection between the scroll casing and the motor and the maintenance thereof are achieved by a simple configuration. Thus, the embodiment has an advantage in cost.

According to the above-described embodiment, the insertion hole and the air introducing port of the scroll casing are provided in such a way as to be coaxial. Thus, the mounting of the fan and the motor is achieved in a state, in which the insertion hole is aligned with the air introducing port, only by inserting the side wall of the motor thereinto along the ring-like rib of the scroll casing.

According to the above-described embodiment, the bracket or the scroll casing is made of a deformable synthetic resin. Thus, the formation of the lock member is easily achieved. And, the entire weight thereof is reduced. Moreover, the mass production thereof is enabled.

According to the above-described embodiment, the cooling duct linking the scroll casing with the motor housing is formed in the bracket. Therefore, the necessity for additional components, such as cooling pipes, is eliminated. Consequently, the cost is decreased.

According to the above-described embodiment, such as cooling pipes, when the bracket is inserted, the side wall formed on the periphery of the cover portion is airtightly engaged with the inner circumferential edge of the insertion hole of the scroll casing. The cooling duct is formed by directly or indirectly linking the opening portion of the side wall with the inside of the scroll casing. Consequently, the bracket can be compacted, and the degree of the airtightness thereof can be increased. Moreover, the necessity for additional components and countermeasures against air leakage, which are needed when a dedicated cooling duct is provided, can be eliminated. The assembly and fabrication of the structure, or the mounting and dismounting of the motor are easily attained. Therefore, the embodiment has an advantage in cost.

According to the above-described embodiment, such as cooling pipes, the diameter of the cover portion of the bracket is larger than that of the fan. The end part of the side wall of the-cover portion is hermetically engaged with the ring-like scroll casing so that air can be introduced into the cooling duct through the opening portion opened in the ring-like rib and the opening portion of the side wall. Thus, the bracket can be compacted, and degree of the airtightness thereof can be increased. Moreover, the need for additional components and countermeasures against air leakage, which are needed when a dedicated cooling duct is provided, can be eliminated. Also, the assembly and fabrication of the structure, or the mounting and dismounting of the motor are easily attained. Therefore, the embodiment has an advantage in cost.

According to the above-described embodiment, the opening portion opened in the side wall of the bracket faces an airflow passage of the scroll casing, which increases in axial dimension according to a winding angle. Thus, the sharing of a part of the wall of the scroll casing is achieved by utilizing such a side wall of the bracket. Also, the linking of the opening portions by the cooling duct is achieved only by the insertion of the bracket. Consequently, the embodiment has an advantage in cost.

According to the above-described embodiment, the peripheral groove portion is formed in the side wall of the bracket along the circumferential direction, and the peripheral groove portion faces the airflow passage of the scroll casing. Thus, the sectional area of the airflow passage increases, and the ventilation resistance thereof is low. Therefore, a larger amount of air can be supplied therethrough. Also, in some case, the scroll casing can be compacted. The linking of the opening portions by the cooling duct is airtightly achieved only by the insertion of the bracket. Consequently, the embodiment has an advantage in cost.

According to the above-described embodiment, the opening portion provided in the side wall of the cover portion of the bracket faces the opening portion provided in the side wall of the scroll casing, so that the cooling duct links both these opening portions. Thus, the cooling air can be introduced thereinto from a given position.

According to the above-described embodiment, the opening portion is formed in the vicinity of the nose portion of the scroll casing. Thus, cooling air can be introduced from the high pressure portion, so that sufficient cooling air is obtained.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. A motor mounting structure comprising:

a scroll casing adopted to surround a fan;

a bracket adopted to mount a motor, which drives the fan;

an insertion hole formed on the scroll casing for inserting the fan therethrough;

a ring-like rib erected on an inner circumferential edge of the insertion hole;

a side wall disposed to the bracket in a manner to face the ring-like rib;

a helical groove portion formed in one of an outer surface of the side wall and an inner surface of the ring-like rib; and a protruding portion engaging with the helical groove portion formed in the other of the outer surface of the side wall and the inner surface of the ring-like rib, wherein the bracket is attached onto the scroll casing by screwing the bracket into the scroll casing in a direction opposite to a direction of rotation of the fan, and in a state that the helical groove portion and the protruding portion are engaged with each other.

2. The motor mounting structure as claimed in claim 1, wherein the bracket and the ring-like rib are configured in a manner that a terminal end portion of the side wall comes into intimate contact with a leading end portion of the ring-like rib when the bracket is attached onto the scroll casing.

3. The motor mounting structure as claimed in claim 1, wherein at least one of the bracket and the scroll casing include a lock member adopted to sustain an engagement state between the helical groove portion and the protruding portion.

4. The motor mounting structure as claimed in claim 3, wherein the protruding portion comprises a pin-like protruding portion, wherein the helical groove portion comprises a step-like portion adopted to prevent the pin-like protruding portion from retreating when the pin-like protruding portion is once fitted thereinto.

5. The motor mounting structure as claimed in claim 1, wherein the scroll casing further comprising an air introducing port adopted to take air thereinto when the fan is driven, wherein the insertion hole is formed in a manner so as to be coaxial with the air introducing port.

6. The motor mounting structure as claimed in claim 1, wherein at least one of the bracket and the scroll casing is made of a deformable synthetic resin.

7. The motor mounting structure as claimed in claim 1, wherein the bracket comprises a motor housing adopted to mount the motor therein, wherein at least one of the bracket and the scroll casing comprises a cooling duct connecting an interior of the scroll casing with an interior of the motor housing.

8. A motor mounting structure comprising:

a scroll casing adopted to surround a fan, having an insertion hole for inserting the fan thereinto formed in a wall portion at a side thereof; and a bracket adopted to mount a motor, which drives the fan, having a motor accommodating portion adopted to accommodate the motor, a cover portion adopted to close the insertion hole, and a cooling duct adopted to introduce a part of air flowing within the scroll casing into the motor for cooling the motor, wherein the bracket further comprising:

a side wall perpendicular to a wall portion of the scroll casing, formed in a peripheral part of the cover portion, adopted to hermetically engage with an inner circumferential edge of the insertion hole when the cover portion is inserted into the scroll casing; and an opening portion formed in a peripheral part of the cover portion, adopted to be connected with the cooling duct so as to introduce a part of air flowing within the scroll casing into the motor through the cooling duct.

9. The motor mounting structure as claimed in claim 8, further comprising:

a ring-like rib formed on an inner circumferential edge of the scroll casing; and an opening part formed in the ring-like rib, wherein the cover portion has an outer diameter larger than that of the fan, wherein an end portion of the side wall and an end portion of the ring-like rib hermetically engage with each other, wherein a part of air within the scroll casing is introduced into the cooling duct through the opening part and the opening portion.

10. The motor mounting structure as claimed in claim 8, wherein the opening portion faces an airflow passage of the scroll casing.

11. The motor mounting structure as claimed in claim 8, wherein an air passage of the scroll casing is formed so as to enlarge in size in an axial direction with respect to a winding angle thereof.

12. The motor mounting structure as claimed in claim 8, further comprising a peripheral groove portion formed in the side wall along a circumferential direction thereof, wherein the peripheral groove portion faces an airflow passage of the scroll casing in a manner so as to increase a sectional area of the airflow passage.

13. The motor mounting structure as claimed in claim 8, further comprising a second opening portion formed in a side wall of the scroll casing, wherein the opening portion and the second opening portion are face each other, wherein the opening portion and the second opening portion are linked by the cooling duct.

14. The motor mounting structure as claimed in claim 12, wherein the second opening portion is formed in a vicinity of a nose portion of the scroll casing.

* * * * *